US008182555B2

(12) United States Patent
Tock et al.

(10) Patent No.: US 8,182,555 B2
(45) **Date of Patent: *May 22, 2012**

(54) NANO-SIZED ZINC OXIDE PARTICLES FOR FUEL

(75) Inventors: Richard W. Tock, Humbolt, IA (US); Arlene Hernandez, Brownfield, TX (US); James Kenneth Sanders, Lubbock, TX (US); Duck Joo Yang, Flower Mound, TX (US)

(73) Assignee: James Kenneth Sanders, Lubbock, TX (US)

( * ) Notice: Subject to any disclaimer, the term of this patent is extended or adjusted under 35 U.S.C. 154(b) by 317 days.

This patent is subject to a terminal disclaimer.

(21) Appl. No.: 12/415,063

(22) Filed: Mar. 31, 2009

(65) Prior Publication Data

US 2010/0242344 A1 Sep. 30, 2010

(51) Int. Cl.
*C10L 1/12* (2006.01)

(52) U.S. Cl. ..... 44/357; 44/457

(58) Field of Classification Search ..... 44/357, 44/457

See application file for complete search history.

(56) References Cited

U.S. PATENT DOCUMENTS

| | | | | |
|---|---|---|---|---|
| 5,266,082 | A * | 11/1993 | Sanders | 44/357 |
| 5,433,756 | A | 7/1995 | Gonzalez | |
| 5,525,316 | A | 6/1996 | Shustorovich et al. | |
| 5,823,758 | A | 10/1998 | Lack | |
| 5,951,722 | A | 9/1999 | Sanders et al. | |
| 6,110,237 | A | 8/2000 | Spencer et al. | |
| 6,113,660 | A | 9/2000 | Hubbard et al. | |
| 6,152,972 | A | 11/2000 | Shustorovich et al. | |
| 6,312,480 | B1 | 11/2001 | Jakob et al. | |
| 6,866,010 | B2 | 3/2005 | May | |
| 7,229,482 | B2 | 6/2007 | May | |
| 2006/0254130 | A1 | 11/2006 | Scattergood | |
| 2009/0217570 | A1 * | 9/2009 | Hobson et al. | 44/370 |

OTHER PUBLICATIONS

International Search Report for International Application No. PCT/US 08/66016 dated Aug. 19, 2008.

Written Opinion of the International Searching Authority for International Application No. PCT/US 08/66016 dated Aug. 19, 2008.

* cited by examiner

*Primary Examiner* — Cephia D Toomer

(74) *Attorney, Agent, or Firm* — Turocy & Watson, LLP

(57) ABSTRACT

A fuel composition contains a liquid fuel and a specific amount of nano-sized zinc oxide particles. The nano-sized zinc oxide particles can be used to either improve combustion or increase catalytic chemical oxidation of fuel.

23 Claims, 2 Drawing Sheets

Hydrocarbon Emissions for Three Different Vehicles at Idle and with the Engine at 2000rpm Octane Number Reading With Additive

NANO-SIZED ZINC OXIDE PARTICLES FOR FUEL

TECHNICAL FIELD

Provided are nano-sized zinc oxide particles to facilitate fuel combustion, methods of improving fuel combustion using nano-sized zinc oxide particles, and fuel containing nano-sized zinc oxide particles.

BACKGROUND

Engine manufacturers continue to seek improved fuel economy through engine design. Alternative approaches in improving fuel economy include formulating new fuels and engine oils. Combustion engines such as automobile engines typically require high octane gasoline for efficient operation. In the past, lead was added to gasoline to increase the octane number. Due to health and environmental concerns, however, lead was removed from gasoline. Lead can also poison a catalytic converter dramatically reducing its lifetime. Oxygenates, such as methyl-t-butyl ether (MTBE) and ethanol, may be added to gasoline to increase the octane number. While generally less toxic than lead, some suggest MTBE can be linked to ground water contamination. There is also a desire by some to reduce some of the high octane components normally present in gasoline, such as benzene, aromatics, and olefins.

SUMMARY

The following presents a simplified summary of the invention in order to provide a basic understanding of some aspects of the invention. This summary is not an extensive overview of the invention. It is intended to neither identify key or critical elements of the invention nor delineate the scope of the invention. Rather, the sole purpose of this summary is to present some concepts of the invention in a simplified form as a prelude to the more detailed description that is presented hereinafter.

The subject invention provides nano-sized zinc oxide particles that can be used to improve combustion, decrease harmful exhaust emissions, and increase catalytic chemical oxidation of fuel.

One aspect of the invention relates to a fuel composition containing a liquid fuel and a specific amount of nano-sized zinc oxide particles. Another aspect of the invention relates to a fuel additive composition containing a carrier/organic solvent and nano-sized zinc oxide particles. Other aspects of the invention include methods of making nano-sized zinc oxide particles, methods of making fuel compositions with nano-sized zinc oxide particles suspended therein, methods of improving combustion, and methods of increasing catalytic chemical oxidation of a fuel composition.

To the accomplishment of the foregoing and related ends, the invention comprises the features hereinafter fully described and particularly pointed out in the claims. The following description and the annexed drawings set forth in detail certain illustrative aspects and implementations of the invention. These are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION

Figure 1:
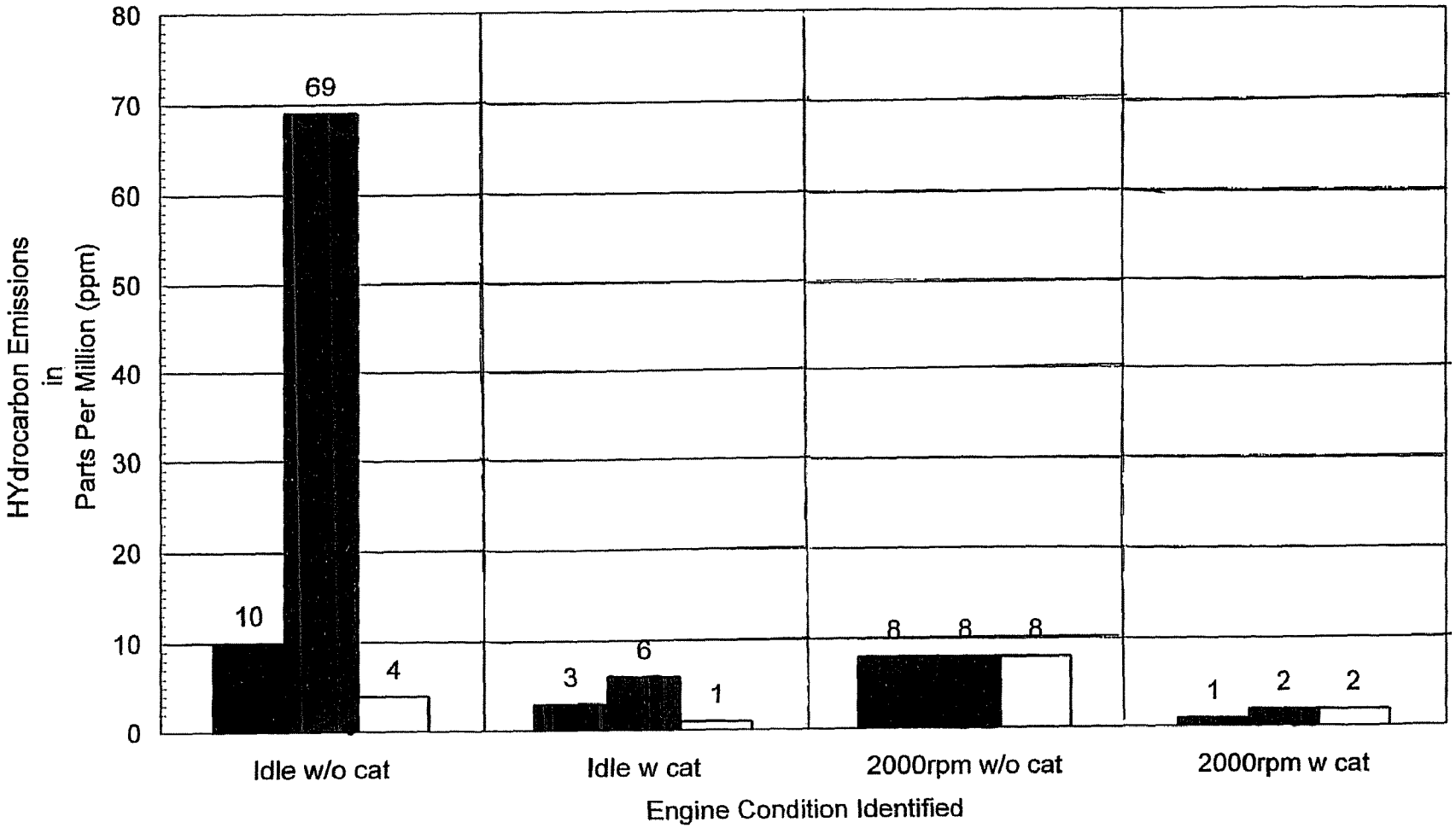
FIG. 1 illustrates a bar graph demonstrating the hydrocarbon emissions from various fuels from various engines.

Nano-sized zinc oxide particles are combined with fuel to improve fuel combustion. The nano-sized zinc oxide particles may be present in a fuel additive composition which is combined (that is, either suspended or dispersed) with fuel to make a fuel composition, or present in a fuel composition.

While not wishing to be bound by any theory, when nano-sized zinc oxide particles are present in a liquid fuel composition which is oxidized in the combustion process, an added energy source is provided. The nano-sized zinc oxide particles may increase the catalytic chemical oxidation or combustion of hydrocarbon based fuels. Consequently, an increase in engine power is achieved. Still not wishing to be bound by any theory, it is believed that a specific amount of nano-sized zinc oxide particles present in a liquid fuel composition provide a catalytic surface capable of supplying oxygen to the combustion process during transient reducing atmospheric episodes generated by the combustion process. Since the combustion process is more complete, an environmentally friendly internal combustion engine fuel is provided.

Again, still not wishing to be bound by any theory, it is believed that a specific amount of nano-sized zinc oxide particles present in a liquid fuel composition permits the zinc oxide to pass through its sublimation temperature range during the combustion process thereby providing added energy output to the combustion process. Minor contaminants in the form of zinc and/or zinc peroxide are converted into zinc oxide during the combustion process, which in turn can pass through its sublimation temperature range providing added energy output to the combustion process. In one embodiment, contaminants in the form of zinc and/or zinc peroxide (especially nano-sized zinc and/or zinc peroxide) can be present in an amount of about 10 ppm or less. In another embodiment, contaminants in the form of zinc and/or zinc peroxide (especially nano-sized zinc and/or zinc peroxide) can be present in an amount of about 5 ppm or less.

The specific amount of nano-sized zinc oxide particles may also be involved in other reactions that improve the combustion. For example, the specific amount of nano-sized zinc oxide particles can sequester low levels of water which otherwise can contaminate fuels, especially marine fuels or those fuels containing oxygenates such as alcohol. It is believed that this sequestration with the presence of ethanol provides an added benefit by decreasing the sensitivity or difference between the RON and the MON levels for ethanol. The decrease in sensitivity increases the fuels performance when the engine is under load and can give rise to an increased octane rating for the fuel. The specific amount of nano-sized zinc oxide particles may function to form a coating on metal parts within the internal combustion engine, thereby not only adding lubricity but also preventing carbon deposition on the internal engine parts. This reduces engine maintenance.

Nano-sized zinc oxide particles are added to hydrocarbon based fuels to increase power output during combustion. Combustion processes (oxidation of hydrocarbon fuels) can occur an order of magnitude faster by a substantially heterogeneous reaction on solid catalytic surfaces (provided by the nano-sized zinc oxide particles) than do the same oxidation processes in homogeneous gas phase reactions without the zinc oxide particles. The invention thus provides nano-sized solid zinc oxide catalyst having a significantly increased surface area needed for more complete combustion.

The nano-sized zinc oxide particles have a size suitable to catalyze the combustion reaction of fuels, yet have 1) an ability to pass through fuel filters (such as an automobile fuel filter) and 2) at least substantially combust themselves, or sublime, or otherwise be consumed so that particulate emissions are minimized and/or eliminated. In one embodiment, the nano-sized zinc oxide particles have a size where at least about 95% by weight of the particles have a size from about 1 nm to about 100 nm. In this connection, size refers to average cross-section of a particle, such as diameter. In another embodiment, the nano-sized zinc oxide particles have a size where at least about 95% by weight of the particles have a size from about 1 nm to about 70 nm. In yet embodiment, the nano-sized zinc oxide particles have a size where at least about 95% by weight of the particles have a size from about 1.5 nm to about 50 nm. In still yet embodiment, the nano-sized zinc oxide particles have a size where at least about 95% by weight of the particles have a size from about 2 nm to about 25 nm. In still yet embodiment, the nano-sized metal particles and metal oxide particles have a size where at least about 95% by weight of the particles have a size from about 1 nm to about 15 nm. In another embodiment, about 100% by weight of the particles have any of the sizes described above, including a size of less than about 20 nm.

The nano-sized zinc oxide particles have a surface area suitable to catalyze the combustion reaction of fuels and to increase the rate of combustion compared to using the same amount of catalyst in bulk form. Increased surface area is often better achieved via small sized particles rather than particles with high porosity. In one embodiment, the nano-sized zinc oxide particles have a surface area from about 50 $m^2/g$ to about 1,000 $m^2/g$. In another embodiment, the nano-sized zinc oxide particles have a surface area from about 100 $m^2/g$ to about 750 $m^2/g$. In yet another embodiment, the nano-sized zinc oxide particles have a surface area from about 150 $m^2/g$ to about 600 $m^2/g$.

The nano-sized zinc oxide particles have a morphology suitable to catalyze the combustion reaction of fuels, increase the rate of combustion compared to using the same amount of catalyst in bulk form, yet have an ability to pass through fuel filters. Examples of the one or more morphologies the nano-sized zinc oxide particles may have include, spherical, substantially spherical, oval, popcorn-like, plate-like, cubic, pyramidal, cylindrical, and the like. The nano-sized zinc oxide particles may be crystalline, partially crystalline, or amorphous.

Many of the nano-sized zinc oxide particles are commercially available from a number of sources including Sigma-Aldrich Inc. and mknano, a Division of M. K. Impex Canada. Alternatively, zinc oxide can be made by converting a metal salt to its corresponding metal or metal oxide by methods known in the art. The conversion can take place in an inert atmosphere or in air via heating, such as calcining in an inert or atmospheric environment or heating in solution.

Still alternatively, metallic zinc can be melted in a crucible and vaporized above about 900° C. Zinc vapor then reacts with the oxygen in the air to afford ZnO. Zinc oxide particles can be transported into a cooling duct and collected in a bag house. Such an indirect method is commonly known as the French process. The so-called direct method involves mixing zinc ores or roasted sulfide concentrates with coal. Then in a reduction furnace, ore is reduced to metallic zinc and the vaporized zinc can be allowed to react with oxygen to form zinc oxide. The American process involves dissolving the ore of zinc and precipitating with alkali to provide zinc oxide.

In one embodiment, a zinc salt is dissolved in a liquid and subjected to ultrasound irradiation followed by its conversion to zinc oxide. Zinc salts include zinc halides, zinc acetate, zinc methacrylate, zinc stearate, zinc cyclohexanebutyrate, zirconium acetate, and zirconium citrate may be used to make zinc oxide. Any suitable liquid can be used to convert a zinc salt such to a zinc oxide. Examples of liquids include water and organic solvents such as alcohols, ethers, esters, ketones, alkanes, aromatics, and the like. When using an absolute alcohol such as absolute ethanol as the liquid, the alcohol complexes with water that may be liberated during the conversion process.

Methods of making or obtaining zinc oxide particles are known in the art and described in U.S. Pat. No. 7,438,836; U.S. Pat. No. 7,423,512; U.S. Pat. No. 7,371,337; U.S. Pat. No. 6,902,269; U.S. Pat. No. 6,783,744; U.S. Pat. No. 6,887,575; U.S. Pat. No. 5,876,688; all of which are hereby incorporated by reference.

In one embodiment, the fuel contains only nano-sized zinc oxide particles, as the fuel does not contain other metal or metal oxide particles, whether nano-sized or not. In this connection, the fuel can consist essentially of or consist of fuel (including typical fuel components and additives) and the nano-sized zinc oxide particles described herein.

The nano-sized zinc oxide particles (or the fuel compositions or fuel additive compositions) may or may not contain or have coated thereon one or more surfactants. In one embodiment, the nano-sized zinc oxide particles do not contain or have coated thereon one or more surfactants. In another embodiment, the nano-sized zinc oxide particles contain or have coated thereon one surfactant. In yet another embodiment, the nano-sized zinc oxide particles contain or have coated thereon two or more surfactants.

Surfactants can facilitate one or more of suspending the particles within the fuel composition, preventing agglomeration, promoting compatibility between the particles and liquid fuel, and the like. Any suitable surfactant can be employed including ionic surfactants, anionic surfactants, cationic surfactants, amphoteric surfactants, and nonionic surfactants. Surfactants are known in the art, and many of these surfactants are described in McCutcheon's "Volume I: Emulsifiers and Detergents", 1995, North American Edition, published by McCutcheon's Division MCP Publishing Corp., Glen Rock, N.J., and in particular, pp. 1-232 which describes a number of anionic, cationic, nonionic and amphoteric surfactants and is hereby incorporated by reference for the disclosure in this regard. Organic surfactants in some instances are particularly useful.

Examples of anionic (typically based on sulfate, sulfonate or carboxylate anions) surfactants include sodium dodecyl sulfate (SDS), ammonium lauryl sulfate, and other alkyl sulfate salts, sodium laureth sulfate, also known as sodium lauryl ether sulfate (SLES), alkyl benzene sulfonate, soaps, or fatty acid salts (see acid salts).

Examples of cationic (typically based on quaternary ammonium cations) surfactants include cetyl trimethylammonium bromide (CTAB) a.k.a. hexadecyl trimethyl ammonium bromide, and other alkyltrimethylammonium salts, cetylpyridinium chloride (CPC), polyethoxylated tallow amine (POEA), benzalkonium chloride (BAC), and benzethonium chloride (BZT).

Examples of zwitterionic surfactants or amphoteric surfactants include dodecyl betaine, dodecyl dimethylamine oxide, cocamidopropyl betaine, and coco ampho glycinate.

Examples of nonionic surfactants include alkyl poly(ethylene oxide); alkyl polyglucosides, such as octyl glucoside, and decyl maltoside; fatty alcohols such as cetyl alcohol and oleyl alcohol; cocamide MEA, cocamide DEA, and cocamide TEA.

In one embodiment, the fuel composition contains from about 0.001% to about 1% by weight of one or more surfactants. In another embodiment, the fuel composition contains from about 0.01% to about 0.1% by weight of one or more surfactants.

The nano-sized zinc oxide particles can be at least partially suspended, but typically suspended, in a liquid fuel composition in any suitable manner. The relatively small size of the nano-size zinc oxide particles contributes to the inherent ability to remain suspended over a longer period of time compared to relatively larger particles (larger than a micron), even though the density and/or specific gravity of the nano-size zinc oxide particles may be several times greater than the corresponding density and/or specific gravity of the liquid fuel. The longer suspension times mean that the liquid fuel containing the nano-size zinc oxide particles entering the engine over time contains a more uniform and/or consistent dispersion of the nano-size zinc oxide particles.

A suspension contains the nano-sized zinc oxide particles and a carrier fluid that is compatible with the fuel. For example, when the nano-sized zinc oxide particles are made in the alcohol solution, or when toluene or xylenes are used as a carrier fluid, the resulting suspension can be added directly to pump gasoline. Analogously, for diesel fuels, another carrier fluid which is more of a cetane enhancer can be employed. The use of one or more suitable surfactants with a carrier fluid that is compatible with the fuel can enhance the suspension of the nano-sized zinc oxide particles.

The nano-sized zinc oxide particles can be in dry powder form. The powdered form may be prepared by spray drying a suspension of the nano-sized zinc oxide particles. An inert gas such as nitrogen can be used to spray dry the nano-sized zinc oxide particles. The coated powder can then be added to fuel or an engine as a powder or made into a fuel compatible paste. The nano-sized zinc oxide powder can be directly added into the air intake of an engine instead of adding the nano-sized zinc oxide powder to the fuel.

The uniformity of dispersion and/or duration of suspension can also be established or facilitated by the use of one or more suitable surfactants. Examples of such surfactants include amphoteric surfactants, ionic surfactants, and non-ionic surfactants. In one embodiment, however, the surfactant does not contain sulfur atoms. In another embodiment, the surfactant does not contain halide atoms. If employed, the surfactant can be added to the liquid fuel composition before, during, or after the nano-size zinc oxide particles are combined with the fuel. Alternatively, the nano-size zinc oxide particles may be contacted or coated with the surfactant before addition to the fuel. The powdered form can be prepared by spray drying a suspension of the nano-sized zinc oxide particles containing one or more suitable surfactants. Alternatively, oven drying or vacuum drying may be employed to form the surfactant coated particles. To be safe during spray drying, an inert gas such as nitrogen can be used to spray dry the nano-sized zinc oxide particles with surfactant. The nano-sized zinc oxide powder coated with surfactant can then be added to fuel.

The uniformity of dispersion and/or duration of suspension can also be established or facilitated by mixing, stirring, blending, shaking, sonicating, or otherwise agitating the liquid fuel composition containing the nano-size zinc oxide particles.

The liquid fuel composition contains a suitable amount of at least partially suspended nano-sized zinc oxide particles to catalyze the combustion reaction of fuels. In one embodiment, the liquid fuel composition contains a liquid fuel and from about 5 ppm to about 60 ppm of suspended nano-sized zinc oxide particles. In another embodiment, the liquid fuel composition contains a liquid fuel and from about 12.5 ppm to about 50 ppm of suspended nano-sized zinc oxide particles. In yet another embodiment, the liquid fuel composition contains a liquid fuel and from about 10 ppm to about 30 ppm of suspended nano-sized zinc oxide particles. In still yet another embodiment, the liquid fuel composition contains a liquid fuel and from about 15 ppm to about 25 ppm of suspended nano-sized zinc oxide particles.

A fuel additive composition provides an efficient means to store and transport the nano-sized zinc oxide particles prior to the addition with a liquid fuel. In one embodiment, the fuel additive composition is simply a dry powder coated with one or more suitable surfactants. Or in another embodiment, no surfactant is used. In another embodiment, the fuel additive composition is a paste containing from about 10% by weight to about 95% by weight of the nano-sized zinc oxide particles and from about 5% by weight to about 90% by weight of a fuel compatible organic solvent and from about 5% by weight to about 10% by weight of one or more suitable surfactants. In yet embodiment, the fuel additive composition is a combination of a carrier liquid and the nano-sized zinc oxide particles and one or more suitable surfactants.

The fuel composition or fuel additive composition may optionally contain a bicyclic aromatic compound. Examples of bicyclic aromatic compounds include naphthalene, substituted naphthalenes, biphenyl compounds, biphenyl compound derivatives, and mixtures thereof. In one embodiment, the fuel composition contains from about 0.01 ppm to about 1000 ppm while the fuel additive composition contains from about 0.1% by weight to about 10% by weight of one or more bicyclic aromatic compounds. In another embodiment, the fuel composition contains from about 0.1 ppm to about 500 ppm while the fuel additive composition contains from about 0.5% by weight to about 5% by weight of one or more bicyclic aromatic compounds.

The nano-sized zinc oxide particles and the optional bicyclic aromatic compound in the fuel additive composition can be dispersed in a carrier liquid to form a fuel additive composition. A carrier liquid has a flash point of at least 100° F. and an auto-ignition temperature of at least 400° F. or is a C1-C3 alcohol. Examples of carrier liquids include one or more of toluene, xylenes, kerosene and C1-C3 monohydric, dihydric or polyhydric aliphatic alcohols. Examples of aliphatic alcohols include methanol, ethanol, n-propanol, isopropyl alcohol, ethylene glycol, propylene glycol, and the like. In one embodiment, the fuel additive composition contains at least 90% by weight of a carrier liquid and no more than 10% by weight of the nano-sized zinc oxide particles.

Some fuels and fuel additives contain relatively large or small quantities of ketones, such as acetone, or ethers, such MTBE. A relatively large or small quantity of a ketone or ether is not necessary in the fuel compositions and fuel additive compositions. In one embodiment, a relatively large quantity (more than 5% by volume) of a ketone or ether is not present in the fuel compositions and/or fuel additive compositions because ketones and ethers may decrease the solubility of the nano-sized zinc oxide particles and undesirably reduce the flash point of the resultant fuel composition.

Fuel compositions are made by combining the nano-sized zinc oxide particles and a liquid fuel. Examples of liquid fuels include hydrocarbon fuels such as gasoline, reformulated gasoline, diesel, jet fuel, marine fuel, kerosene, biofuels such as biodiesel, bioalcohols such as bioethanol, and the like. Gasoline contains one or more of the following components that may, by themselves, constitute liquid fuel: straight-run products, reformate, cracked gasoline, high octant stock, isomerate, polymerization stock, alkylate stock, hydrotreated feedstocks, desulfurization feedstocks, alcohol, and the like.

In one embodiment, the fuel additive composition or the nano-sized zinc oxide particles coated with or without one or more suitable surfactants is/are added to the liquid fuel in an amount sufficient to provide decrease of at least about 15% in hydrocarbon and/or carbon monoxide emissions from the exhaust system as compared to the corresponding emissions from use of the liquid fuel without inclusion of the nano-sized zinc oxide particles. In another embodiment, the fuel additive composition or the nano-sized zinc oxide particles coated with or without one or more suitable surfactants is/are added to the liquid fuel in an amount sufficient to provide decrease of at least about 30% in hydrocarbon and/or carbon monoxide and/or nitrogen oxides emissions from the exhaust system as compared to the corresponding emissions from use of the liquid fuel without inclusion of the nano-sized zinc oxide particles.

In one embodiment, the fuel additive composition or the nano-sized zinc oxide particles coated with or without one or more suitable surfactants is/are added to the liquid fuel in an amount sufficient to provide a decrease of at least 7.5% in the amount of the liquid fuel consumed by the internal combustion engine when compared with the corresponding amount of liquid fuel consumed by the engine when the nano-sized zinc oxide particles are not included. In another embodiment, the fuel additive composition or the nano-sized zinc oxide particles is/are added to the liquid fuel in an amount sufficient to provide a decrease of at least 15% in the amount of the liquid fuel consumed by the internal combustion engine when compared with the corresponding amount of liquid fuel consumed by the engine when the nano-sized zinc oxide particles are not included.

The quality of a fuel such as gasoline can be determined by octane. Octane is measured relative to a mixture of isooctane (2,2,4-trimethylpentane, an isomer of octane) and n-heptane. For example, an 87-octane gasoline has the same octane rating as a mixture of 87 vol-% isooctane and 13 vol-% n-heptane. A low octane rating is undesirable in a gasoline engine. The most common type of octane rating worldwide is the Research Octane Number (RON). RON is determined by running the fuel through a specific test engine with a variable compression ratio under controlled conditions, and comparing these results with those for mixtures of isooctane and n-heptane. In this connection, RON can be determined using the procedure set forth in ASTM D 2699, which is hereby incorporated by reference in its entirety. Another type of octane rating, called Motor Octane Number (MON), which is in some instances a better measure of how the fuel behaves when under load. MON testing uses a similar test engine to that used in RON testing, but with a preheated fuel mixture, a higher engine speed, and variable ignition timing to further stress the fuel's knock resistance. Cetane number or CN a measure of the combustion quality of diesel fuel under compression, one measure of fuel quality. CN is actually a measure of a diesel fuel's ignition delay; the time period between the start of injection and start of combustion (ignition) of the fuel.

In one embodiment, a fuel composition containing a liquid fuel and the nano-sized zinc oxide particles has a higher RON, MON, and/or CN than a RON, MON, and/or CN for a fuel composition with the same ingredients except without the nano-sized zinc oxide particles. In another embodiment, a fuel composition containing a liquid fuel and the nano-sized zinc oxide particles can has about 5% higher RON, MON, and/or CN than a RON, MON, and/or CN for a fuel composition with the same ingredients except without the nano-sized zinc oxide particles. In yet another embodiment, a fuel composition containing a liquid fuel and the nano-sized zinc oxide particles has about 10% higher RON, MON, and/or CN than a RON, MON, and/or CN for a fuel composition with the same ingredients except without the nano-sized zinc oxide particles.

The fuel composition can be effectively used in both fuel-injected and non fuel-injected engines. The fuel composition can be effectively used in two-stroke engines, four-stroke engines, and vehicle engines such as automobile engines, motorcycle engines, jet engines (jet turbine engines), marine engines, truck/bus engines, and the like. The fuel composition can be effectively used in any type of internal combustion engine including an Otto-cycle engine, a diesel engine, a rotary engine, and a gas turbine engine. The fuel composition can be effectively used in an intermittent internal combustion engine or a continuous internal combustion engine.

The fuel composition can supply to the fuel chamber the liquid fuel and the nano-sized zinc oxide particles as a mixture, or the liquid fuel and the nano-sized zinc oxide particles can be supplied to the fuel chamber separately.

The fuel compositions are tailored to reduce the percentages of hydrocarbons, carbon monoxide, nitrogen oxides, and molecular oxygen in motor vehicle exhaust emissions. Use of the fuel compositions may also result in a desirable increase in the percentage of carbon dioxide in combustion exhaust emissions. Thus, the fuel compositions, when used to fuel internal combustion engines, lead to efficient operation and the resultant emissions meet or exceed E.P.A. standards. The fuel compositions are also tailored to have more effective combustion thereby reducing little or less deposition of carbon residue in the internal chamber of the combustion engine.

The following examples illustrate the subject invention. Unless otherwise indicated in the following examples and elsewhere in the specification and claims, all parts and percentages are by weight, all temperatures are in degrees Centigrade, and pressure is at or near atmospheric pressure.

Table 1 reports hydrocarbon emissions in parts per million (ppm) from three different engines at idle and at 2000 rpm using a fuel without the nano-sized metal and/or metal oxide particles and a fuel with the nano-sized metal and/or metal oxide particles. The base fuel is regular unleaded gasoline having an octane rating of 87. The nano-sized metal and/or metal oxide particles are present at a level of about 50 ppm and are zinc oxide particles having a size from 1 nm to 20 nm. Engine 1 is a year 2002 Ford F-150 pick-up V-8; engine 2 is a year 2000 Dodge Ram pick-up V-8; and engine 3 is a 1999 Audi A8 V-8. Hydrocarbon emissions are measured using a five gas analyzer with a tailpipe probe (Model 5002 Exhaust Gas Analyzer made by Emission Systems Inc.).

TABLE 1

| Engine | idle w/o cat | idle w cat | 2000 rpm w/o cat | 2000 rpm w cat |
|---|---|---|---|---|
| 1 | 10 | 3 | 8 | 1 |
| 2 | 69 | 6 | 8 | 2 |
| 3 | 4 | 1 | 8 | 2 |

FIG. 1 is a bar graph for hydrocarbon readings to facilitate visual comparisons of emissions reported in Table 1. On the bar graph of FIG. 1, the first set of bars (idle w/o cat) shows the hydrocarbon emissions from three engines at idle using a fuel without the nano-sized metal and/or metal oxide particles. The second set of bars (idle w cat) shows hydrocarbon emissions from the same three engines at idle using a fuel with the nano-sized metal and/or metal oxide particles. The final two sets of bars (2000 rpm w/o cat and 2000 rpm w cat) shows the hydrocarbon emissions either without or with the nano-sized metal and/or metal oxide particles from the same three engines, but with the engine turning at 2000 rpm (a typical turn rate for highway travel). For both idle and cruising engine turning rates, the reduction in hydrocarbon emissions is substantial.

Table 2 reports nitrogen oxide (NOx) emissions in parts per million (ppm) from two different engines at idle and at 2000 rpm using a fuel without the nano-sized metal and/or metal oxide particles and a fuel with the nano-sized metal and/or metal oxide particles. For both idle and cruising engine turning rates, the reduction in nitrogen oxide emissions is substantial. The base fuel is regular unleaded gasoline having an octane rating of 87. The nano-sized metal and/or metal oxide particles are present at a level of about 50 ppm and are zinc oxide particles having a size from 1 nm to 20 nm. Engine 1 is a year 2002 Ford F-150 pick-up V-8 and engine 3 is a 1999 Audi A8 V-8. Nitrogen oxide emissions are measured using a five gas analyzer with a tailpipe probe (Model 5002 Exhaust Gas Analyzer made by Emission Systems Inc.).

TABLE 2

| Engine | idle w/o cat | idle w cat | 2000 rpm w/o cat | 2000 rpm w cat |
|---|---|---|---|---|
| 1 | 10 | 1 | 207 | 31 |
| 3 | 3 | 0 | 37 | 2 |

Table 3 reports carbon dioxide emissions in parts per million (ppm) from three different engines at idle and at 2000 rpm using a fuel without the nano-sized metal and/or metal oxide particles and a fuel with the nano-sized metal and/or metal oxide particles. The base fuel is regular unleaded gasoline having an octane rating of 87. The nano-sized metal and/or metal oxide particles are present at a level of about 50 ppm and are zinc oxide particles having a size from 1 nm to 20 nm. Engine 1 is a year 2002 Ford F-150 pick-up V-8 and engine 2 is a year 2000 Dodge Ram pick-up V-8. Carbon dioxide emissions are measured using a five gas analyzer with a tailpipe probe (Model 5002 Exhaust Gas Analyzer made by Emission Systems Inc.).

TABLE 3

| Engine | idle w/o cat | idle w cat | 2000 rpm w/o cat | 2000 rpm w cat |
|---|---|---|---|---|
| 1 | 13.8 | 13.7 | 17.7 | 15 |
| 2 | 14.3 | 14.7 | 14.9 | 14.8 |

Table 4 reports octane ratings from five different fuel compositions; one without the nano-sized metal and/or metal oxide particles additive and four with varying amounts of the nano-sized metal and/or metal oxide particles additive. Each of the five different fuel compositions contains Murphy's USA regular unleaded fuel having an octane rating of 87 with or without an additive. The additive is a different amount of 1 nm to 20 nm zinc oxide particles. The octane number is measured using an IR scanner (Model ZX-101XL portable octane and fuel analyzer made by Zeltex Inc.).

TABLE 4

| Fuel | Octane Reading |
|---|---|
| without additive | 87.1 |
| with 50 ppm additive | 87.8 |
| with 100 ppm additive | 88.2 |

TABLE 4-continued

| Fuel | Octane Reading |
|---|---|
| with 150 ppm additive | 88.6 |
| with 200 ppm additive | 88.8 |

Figure 2:
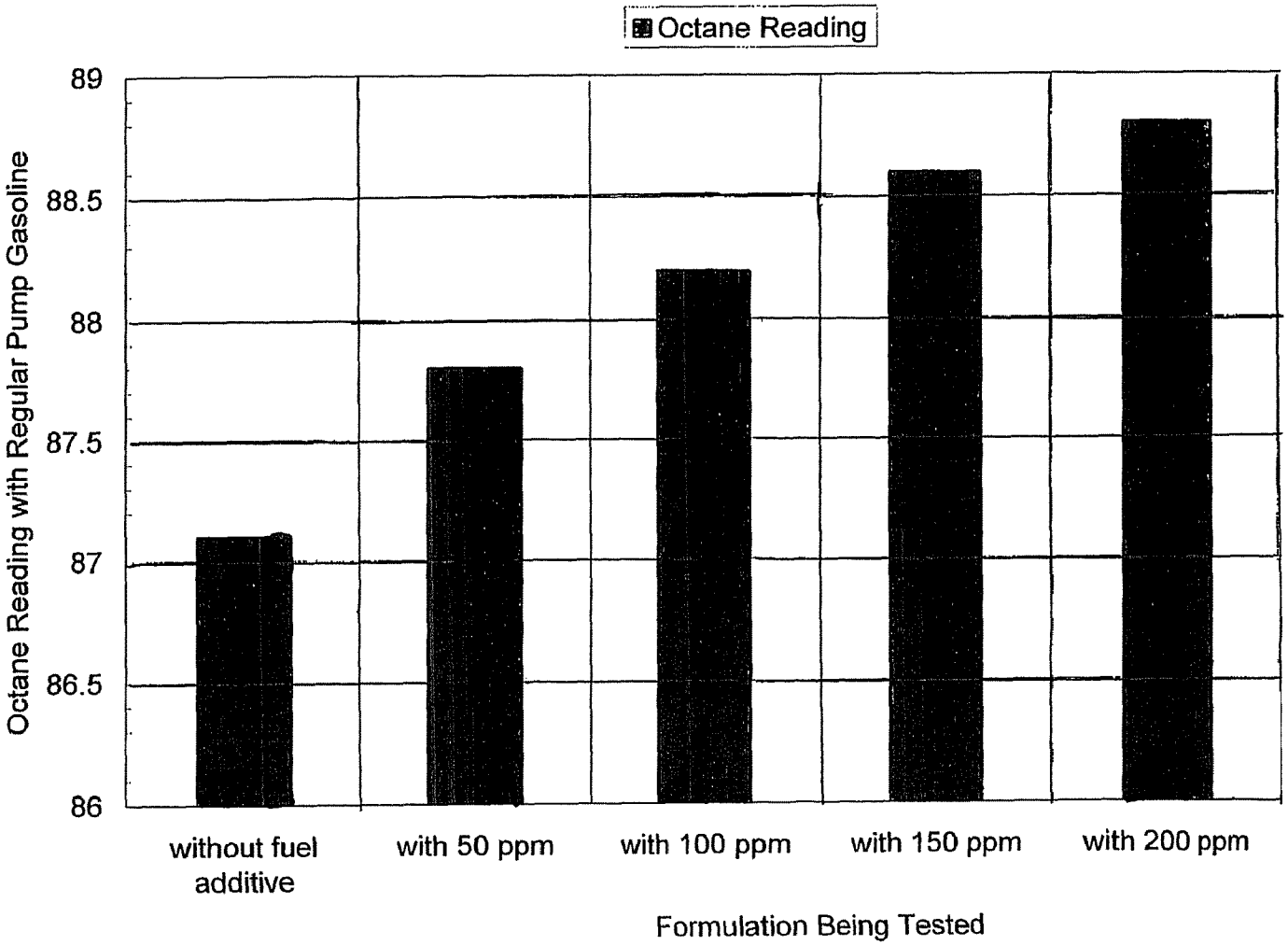
FIG. 2 illustrates a bar graph demonstrating the octane ratings of various fuel compositions.

FIG. 2 is a bar graph for octane readings to facilitate visual comparisons of the fuel compositions reported in Table 4. On the bar graph of FIG. 2, the first bar shows the octane reading from a fuel composition without the nano-sized metal and/or metal oxide particles while the second to fifth bars show fuel compositions with varying amounts of the nano-sized metal and/or metal oxide particles. All of the fuel compositions with varying amounts of the nano-sized metal and/or metal oxide particles have higher octane readings than the fuel composition without the nano-sized metal and/or metal oxide particles.

Table 5 illustrates that NOx emissions from diesel fuel with catalyst were reduced from 125 ppm level to 58 ppm level: approximately a 53% reduction. Each of the two different diesel fuel compositions contains Phillips's USA diesel fuel with or without an additive. The additive is 1 nm to 20 nm zinc oxide particles. Nitrogen oxide emissions are measured using a five gas analyzer with a tailpipe probe (Model 5002 Exhaust Gas Analyzer made by Emission Systems Inc.).

TABLE 5

NO*x* Reduction Test Results using Diesel Fuel with/without catalyst

| | NO*x* (ppm) | |
|---|---|---|
| Engine Speed: | Idle | 2,000 rpm |
| 1) Diesel w/o catalyst | 264 | 125 |
| 2) Diesel w/catalyst | 257 | 58 |

The data were calculated from averaged where multiple readings were taken at two engine speeds: 1) Idle and 2) 2,000 rpm. As shown in Table 5, two different fuel compositions were used; 1) diesel fuel only and 2) diesel with catalyst. These two fuels were run sequentially with an initial pump diesel base line followed by testing with diesel/catalyst.

Flight tests were performed at an altitude of 3000 feet. A twin engine piston airplane was used. The fuel delivery system had been modified so that only one engine received fuel treated with catalyst. The engines used in the test with catalyst were Lycoming 160 HP four cylinder engine with fuel injection. The engine was run at two speeds: 100% (Max) power, 2750 rpm, 2500 Manifold Pressure, and at 75% power, 2500 rpm, with a 2200 Manifold Pressure.

The fuel used was 100 octane, low lead, aviation gasoline (Avgas). The emissions data obtained suggest that this fuel was also sulfur free, since no SOx was observed in the exhaust gases. The catalyzed fuel contain fifty parts per million (50 ppm) of research grade, zinc oxide nano particles, which were added to the fuel as a dry powder. Tests were conducted using set (uninterrupted) cruise power setting while switching from main tank (fuel with no zinc oxide) to auxiliary tank (fuel with 50 ppm of zinc oxide nano particles) and recording readings.

Gaseous emissions were monitored with a state of the art ENERAC Model 700 instrument. This instrument provides digital read out of: C0%, $CO_2$%, NO ppm, $NO_2$ ppm with the sum as NOx ppm, Exhaust Gas Temperature (° F.), Cylinder Head Temperature (° F.), and fuel flow (gallons per hour). The results are reported in Tables 6 and 7.

TABLE 6

| 75% Power, 2200 Manifold Pressure - 2500 RPM | | | | | | | |
|---|---|---|---|---|---|---|---|
| CO % | $CO_2$ % | NO | $NO_2$ | NOx | EGT | CHT | Fuel Flow |
| MAIN TANK - no zinc oxide | | | | | | | |
| 2.1% | 2.4% | 141.9 | 2.9 | 141.9 | 1260° F. | 315° F. | 14.5 gph |
| AUXILIARY TANK - with 50 ppm of zinc oxide nano particles | | | | | | | |
| 2.0% | 2.3% | 137.2 | 0.0 | 137.2 | 1230° F. | 305° F. | 13.4 gph |

TABLE 7

| 100% (Max) Power, 2500 Manifold Pressure - 2750 RPM | | | | | | | |
|---|---|---|---|---|---|---|---|
| CO % | $CO_2$ % | NO | $NO_2$ | NOx | EGT | CHT | Fuel Flow |
| MAIN TANK - no zinc oxide | | | | | | | |
| 2.1% | 5.4% | 587.1 | 7.7 | 594.8 | 1360° F. | 364° F. | 16.3 gph |
| AUXILIARY TANK - with 50 ppm of zinc oxide nano particles | | | | | | | |
| 1.7% | 4.7% | 327.2 | 0.0 | 372.2 | 1310° F. | 310° F. | 14.8 gph |

If the nano-size zinc oxide behaves as a catalyst, then the cylinder head temperature and hence the exhaust gas temperature should decrease. The test results demonstrate that use of the nano-size zinc oxide behaved as a catalyst thereby reducing the cylinder head temperature and the exhaust gas temperature.

If cylinder head temperature is reduced, then NOx emission should decrease. The test results demonstrate that use of the nano-size zinc oxide reduced NOx emissions compared to fuels without the zinc oxide. The test data also indicates that the $NO_2$ to NO ratio was less than 0.3, in which case the reaction of NO with ozone is at about the same rate as the formation of NO. Consequently, this keeps the ambient ozone concentration level below harmful levels. Use of the nano-size zinc oxide actually reduces the $NO_2$ emissions to below detectable levels. Without $NO_2$ and sunlight, no ozone can be formed.

If the nano-size zinc oxide promotes better combustion, then the products of incomplete combustion (PICs), such as monoxide (CO) and hydrocarbons (HC), should decrease. The test results demonstrate that use of the nano-size zinc oxide reduced CO emissions compared to fuels without the zinc oxide. The ENERAC Model 700 does not provide any hydrocarbon (HC) data.

If more power is delivered through better combustion then the fuel economy should increase. The test results demonstrate that use of the nano-size zinc oxide increased fuel economy. In this test, this important effect is observed as the fuel flow decreases when the catalyst was used. For a constant air speed, the fuel flow per hour can be translated into air miles per gallon of fuel; or miles per gallon (mpg) for land based vehicles.

With respect to any figure or numerical range for a given characteristic, a figure or a parameter from one range may be combined with another figure or a parameter from a different range for the same characteristic to generate a numerical range.

While the invention has been explained in relation to certain embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A fuel composition comprising:

a liquid fuel;

suspended within the liquid fuel from about 5 ppm to about 60 ppm of nano-sized zinc oxide particles, wherein at least about 95% by weight of the nano-sized zinc oxide particles having a size from about 1 nm to about 70 nm; and from about 0.001% to about 0.5% by weight of a surfactant.

2. The fuel composition of claim 1, wherein the nano-sized metal particles or the nano-sized metal oxide particles or combinations thereof have a surface area from about 50 m2/g to about 1,000 m2/g.

3. The fuel composition of claim 1 comprising from about 7.5 ppm to about 50 ppm of nano-sized zinc oxide particles.

4. The fuel composition of claim 1 comprising from about 10 ppm to about 30 ppm of nano-sized zinc oxide particles.

5. The fuel composition of claim 1, wherein at least about 95% by weight of the nano-sized zinc oxide particles having a size from about 1.5 nm to about 50 nm.

6. The fuel composition of claim 1 comprising nano-sized zinc oxide particles having a substantially spherical shape.

7. The fuel composition of claim 1 further comprising from about 0.01% to about 0.1% by weight of a surfactant.

8. The fuel composition of claim 1 having a higher RON, MON, and/or CN than a RON, MON, and/or CN for a second fuel composition comprising the liquid fuel but without the nano-sized zinc oxide particles.

9. The fuel composition of claim 1, wherein the liquid fuel is selected from the group consisting of gasoline, reformulated gasoline, oxygenated gasoline, diesel, jet fuel, marine fuel, biodeisel, bioalcohol, alcohol, and kerosene.

10. A method of improving combustion, comprising:

providing an internal combustion engine with a fuel composition comprising a liquid fuel and suspended therein from about 5 ppm to about 60 ppm of nano-sized zinc oxide particles, wherein at least about 95% by weight of the nano-sized zinc oxide particles have a size from about 1 nm to about 70 nm, the fuel composition further comprising from about 0.001% to about 0.5% by weight of a surfactant.

11. The method of claim 10, wherein the fuel composition comprises from about 10 ppm to about 30 ppm of nano-sized zinc oxide particles.

12. The method of claim 10, wherein at least about 95% by weight of the nano-sized zinc oxide particles having a size from about 1.5 nm to about 50 nm.

13. The method of claim 10, wherein at least about 95% by weight of the nano-sized zinc oxide particles having a size from about 2 nm to about 25 nm.

14. The method of claim 10, wherein the internal combustion engine is one of an Otto-cycle engine, a diesel engine, a rotary engine, and a gas turbine engine.

15. The method of claim 10, wherein improving combustion comprises at least one of:

increasing power output compared to a second fuel composition comprising the liquid fuel but without the nano-sized zinc oxide particles or combinations thereof, catalyzing combustion, and increasing surface area where combustion occurs.

16. A method of increasing catalytic chemical oxidation of a fuel composition, comprising:

providing a fuel composition with a liquid fuel and suspended therein from about 5 ppm to about 60 ppm of nano-sized zinc oxide particles or combinations thereof, wherein at least about 95% by weight of the nano-sized zinc oxide particles have a size from about 1 nm to about 70 nm, the liquid fuel further comprising from about 0.001% to about 0.5% by weight of a surfactant.

17. The method of claim 16 further comprising at least one of mixing, stirring, blending, shaking, and sonicating the fuel composition.

18. The method of claim 16, wherein the nano-sized zinc oxide particles or the combinations thereof are combined with the liquid fuel by combining a fuel additive composition comprising the nano-sized zinc oxide particles and a carrier with the liquid fuel.

19. The method of claim 16, wherein at least about 95% by weight of the nano-sized zinc oxide particles having a size from about 1.5 nm to about 50 nm.

20. The method of claim 16, wherein at least about 95% by weight of the nano-sized zinc oxide particles having a size from about 2 nm to about 25 nm.

21. A method of making a fuel composition comprising:

suspending from about 5 ppm to about 60 ppm of nano-sized zinc oxide particles in a liquid fuel, wherein at least about 95% by weight of the nano-sized zinc oxide particles have a size from about 1 nm to about 70 nm.

22. The method of claim 21 further comprising stirring, blending, shaking, sonicating, or agitating the fuel composition.

23. The method of claim 21, wherein the liquid fuel further comprises from about 0.001% to about 0.5% by weight of a surfactant.

* * * * *